US007686526B2

(12) United States Patent
Chi et al.

(10) Patent No.: US 7,686,526 B2
(45) **Date of Patent: *Mar. 30, 2010**

(54) DOCUMENT FEEDER DEVICE

(75) Inventors: Hye Suk Chi, Raleigh, NC (US); Robert Andrew Myers, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 7 days.

This patent is subject to a terminal disclaimer.

(21) Appl. No.: 12/117,719

(22) Filed: May 8, 2008

(65) Prior Publication Data

US 2008/0203651 A1 Aug. 28, 2008

Related U.S. Application Data

(63) Continuation of application No. 10/633,958, filed on Aug. 4, 2003, now Pat. No. 7,390,136.

(51) Int. Cl.
*B41J 13/00* (2006.01)

(52) U.S. Cl. ..... 400/578; 400/636; 271/125

(58) Field of Classification Search ..... None
See application file for complete search history.

(56) References Cited

U.S. PATENT DOCUMENTS

| | | | | |
|---|---|---|---|---|
| 3,441,188 | A | 4/1969 | May et al. | |
| 3,584,577 | A | 6/1971 | Jeschke | |
| 4,024,782 | A | 5/1977 | Kron et al. | |
| 4,035,044 | A * | 7/1977 | Miyazaki | 384/447 |
| 4,753,431 | A | 6/1988 | Fujimoto et al. | |
| 4,901,117 | A | 2/1990 | Derrick | |
| 5,397,289 | A | 3/1995 | Entz et al. | |
| 5,414,450 | A | 5/1995 | Oshino et al. | |
| 5,511,774 | A | 4/1996 | Lyga | |
| 5,527,030 | A * | 6/1996 | Kimura et al. | 271/185 |
| 5,662,038 | A | 9/1997 | Schaum et al. | |
| 5,702,191 | A | 12/1997 | Kakizaki et al. | |
| 5,795,087 | A | 8/1998 | Brower et al. | |
| 5,987,954 | A * | 11/1999 | Hauck et al. | 72/248 |
| 6,008,832 | A | 12/1999 | Sato | |
| 6,109,180 | A | 8/2000 | Guaraldi et al. | |
| 6,122,978 | A | 9/2000 | Callendrier | |
| 6,216,592 | B1 * | 4/2001 | Knauer et al. | 101/247 |
| 6,227,111 | B1 * | 5/2001 | Dawley et al. | 101/218 |
| 6,318,257 | B1 * | 11/2001 | Niemiro et al. | 101/212 |
| 6,327,444 | B1 | 12/2001 | Hachisuga | |
| 6,585,253 | B1 | 7/2003 | Miki | |
| 2002/0014509 | A1 | 2/2002 | Kitai et al. | |
| 2004/0000125 | A1 | 1/2004 | Cadieux et al. | |
| 2004/0056414 | A1 | 3/2004 | Duesterhus | |

* cited by examiner

*Primary Examiner*—Judy Nguyen
*Assistant Examiner*—Marissa L Ferguson-Samreth
(74) *Attorney, Agent, or Firm*—Jason Piche; Jeffrey L. Streets

(57) ABSTRACT

A document feeder device is disclosed. The document feeder device includes a frame and at least one cantilevered roller shaft for advancing a document, where an unsupported end of the at least one cantilevered roller shaft floats. The document feeder device eliminates the need for a rigid frame to support the unsupported end. This decreases the cost of production by eliminating the need for additional frame hardware and/or more rigid frame hardware. The document feeder device can be implemented in existing designs.

4 Claims, 7 Drawing Sheets

DOCUMENT FEEDER DEVICE

CROSS-REFERENCE TO RELATED APPLICATIONS

Under 35 USC §120, this application is a continuation application and claims the benefit of priority to U.S. patent application Ser. No. 10/633,958, filed Aug. 4, 2003, entitled "Document Feeder Device," which is incorporated herein by reference.

FIELD OF THE INVENTION

The present invention relates to document printers, and more particularly to a system and method for providing a document feeder device that can reliably feed documents through a printer.

BACKGROUND OF THE INVENTION

Printers that print loose, single sheet documents are well known. In the case of many point-of-sale printers, a printer must be capable of printing on a sheet that is wider than the printer. For example, a 4" wide printer must be able to print on one side of an 8½"×11" sheet. Documents to be printed can include preprinted forms that are 8½"×11" or A4, for example, as well as narrower documents such as receipts, checks, etc. Accordingly, to accommodate for documents that are wider than the printer, one side of the printer must be open, e.g., slotted, to allow wider sheets to be feed. For ease of discussion, the terms document and sheet are used interchangeably. A document can be a blank sheet or a pre-printed sheet. Alternatively, a document can be a multi-part or multi-ply form, with or without carbon paper. A sheet is typically of paper but is not limited to paper.

FIG. 1 is a perspective-view photo of a printer 50 with its cover closed and an 8.5"×11" sheet 52 in the printer 50. The printer 50 includes a main portion 54 and a front portion 56 that is coupled to the main portion 54. The front portion 56 is separated from the main portion 54 and positioned relative to the main portion 54 such that a slot 58 is created through which the sheet 52 can be fed.

FIG. 2 is a top-view diagram of a conventional document feeder device 60, which can be used to implement the printer 50 of FIG. 1. Still referring to FIG. 2, the feeder device 60 advances the sheet 52 along a paper path in the slot 58. The document feeder device 60 includes a set of rollers 62-68 disposed around a pair of roller shafts 70 and 72. The sheet 52 is placed parallel to the shafts 70 and 72 and between the rollers 62-68. The roller shafts 70 and 72 rotate in opposite directions to advance the sheet 52 through the printer 50. Because the sheet 52 is wider than the printer 50, the document feeder device 60 is designed to feed the sheet 52 through the slot 58 of the printer 50. The slot 58 is created by a separation between a main portion 54 and a front portion 56 of the printer frame.

A problem with the conventional document feeder device 60 is that if any of the roller shafts 70 and 72 become misaligned, the sheet 52 will skew as it advances through the rollers 62-68. Accordingly, to ensure reliable performance, i.e., accurate paper feeds, the document feeder device 60 is designed to maintain adequate alignment with other components of the document-feed assembly 60 and be designed for maximum stability. Accordingly, to keep the roller shafts 70 and 72 as rigid as possible with maximize stability, the ends of the roller shafts 70 and 72 are directly connected and supported by portions of the printer frame. Specifically, the ends of the roller shaft 70 are directly connected to and supported by bearings 74 and 76, which are connected to and supported by frame supports 78 and 80, respectively. Also, the ends of the roller shaft 72 are directly connected to and supported by bearings 82 and 84, which are connected to and supported by frame supports 86 and 88, respectively. The frame supports 78 and 80 are part of the main portion 54 of the printer frame, and the frame supports 86 and 88 are part of the front portion 56 of the printer frame.

The problem with the conventional document feeder device 60 is that is difficult to provide an adequately rigid and stable mounting surface for the roller shaft 72 when there is a slot 58 separating the main and front portions 54 and 56 of the printer 50. This difficulty exists because if the front portion 56 moves, the frame supports 86 and 88 also move because they are integrated into the front portion 56. The front portion 56 can move due to various reasons. For example, a user might lean on the front portion 56 or might place a heavy object on it, pushing it downward.

Unfortunately, a slight movement of the front portion 56 causes a substantial misalignment between the roller shafts 70 and 72, because the degrees of movement of the frame supports 86 and 88 differ. This difference is created upon movement of the front portion 56 because it is connected to the main portion 54 on one side only, i.e., the left side. For example, if the front portion 56 droops or lowers in any way, the frame support 86 will lower further than the frame support 88. The longer the distance between the frame supports 86 and 88, the larger the magnification. Unfortunately, there is not a way to bridge a support across the front and main portions 54 and 56 without obstructing the paper path.

One conventional solution to the problem is to make the overall printer frame, including the connection between the front and main portions 54 and 56 as rigid as possible. However, doing so increases the cost of production by requiring additional frame hardware and/or more rigid frame hardware.

Accordingly, what is needed is an improved system and method for providing a document feeder device that can more reliably feed documents through a printer. The system and method should be cost effective and easily implemented in existing designs. The present invention addresses such a need.

SUMMARY OF THE INVENTION

A document feeder device is disclosed. The document feeder device includes a frame and at least one cantilevered roller shaft for advancing a document, where an unsupported end of the at least one cantilevered roller shaft floats. The document feeder device eliminates the need for a rigid frame to support the unsupported end. This decreases the cost of production by eliminating the need for additional frame hardware and/or more rigid frame hardware. The document feeder device can be implemented in existing designs.

DETAILED DESCRIPTION OF THE INVENTION

The present invention relates to document printers, and more particularly to a system and method for providing a document feeder device that can reliably feed documents through a printer. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

In accordance with the present invention, the document feeder device comprises at least one cantilevered roller shaft that is supported at one end, i.e., the proximal end. This allows the other end, i.e., the distal end, to float thereby eliminating the need for a rigid frame to support the distal end. The proximate end has adequate support to adequately control the position of the cantilevered roller shaft relative to the rest of the document feeder device. To more particularly describe the features of the present invention, refer now to the following description in conjunction with the accompanying figures.

Figure 1:
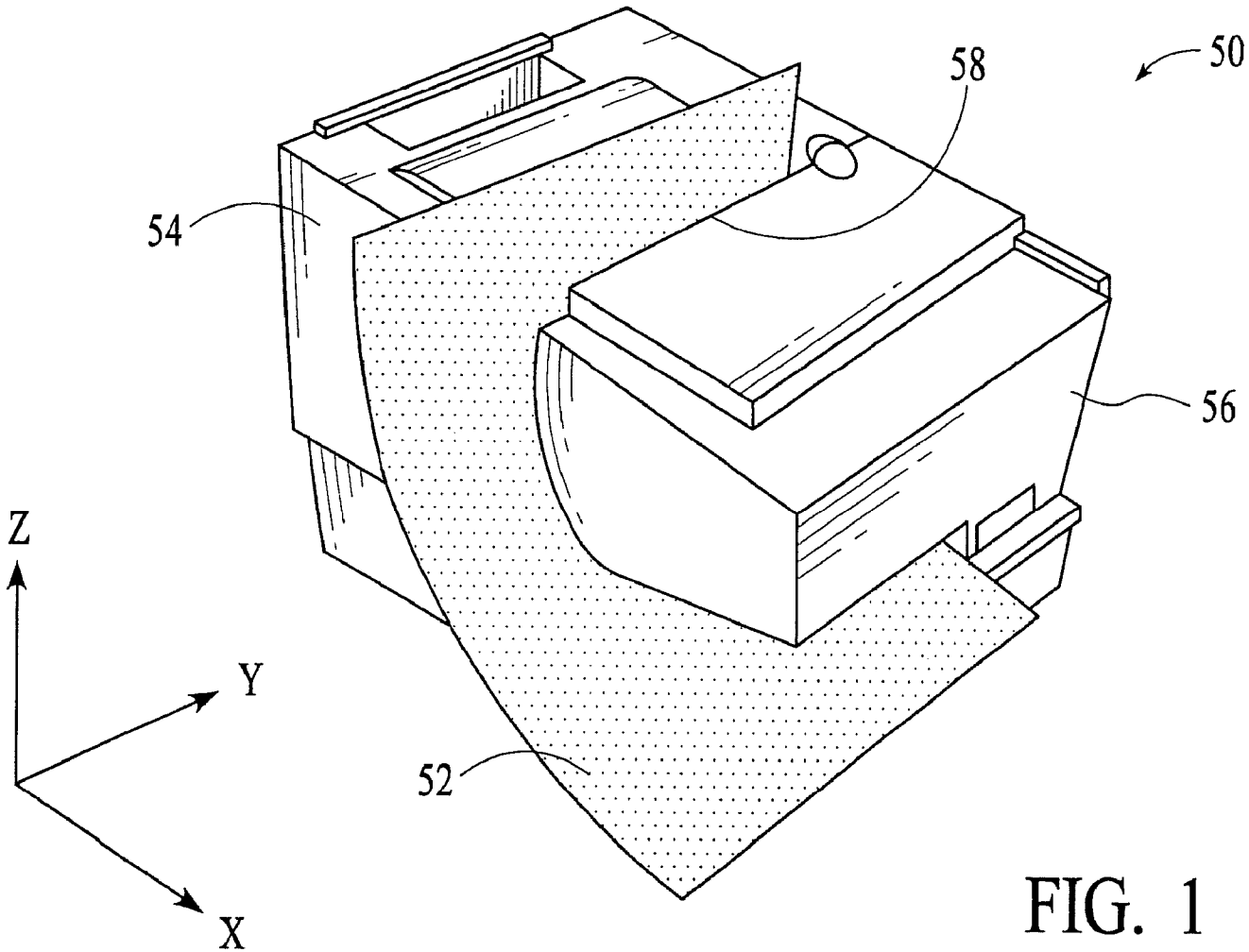
FIG. 1 is a perspective-view photo of a printer with its cover closed and an 8.5"×11" sheet in the printer.
Figure 2:
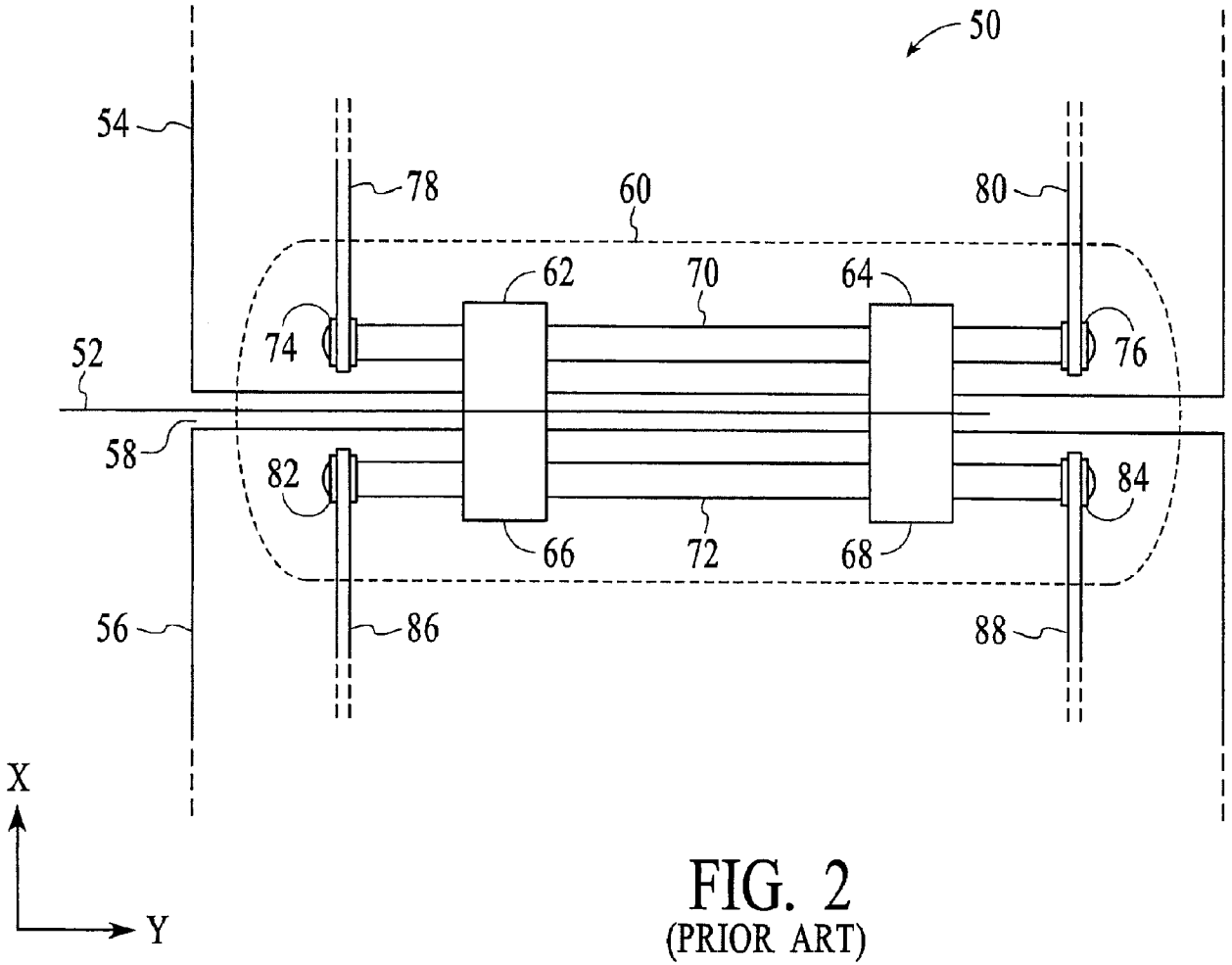
FIG. 2 (PRIOR ART)
FIG. 2 is a top-view diagram of a conventional document feeder device, which can be used to implement the printer of FIG. 1.
Figure 3:
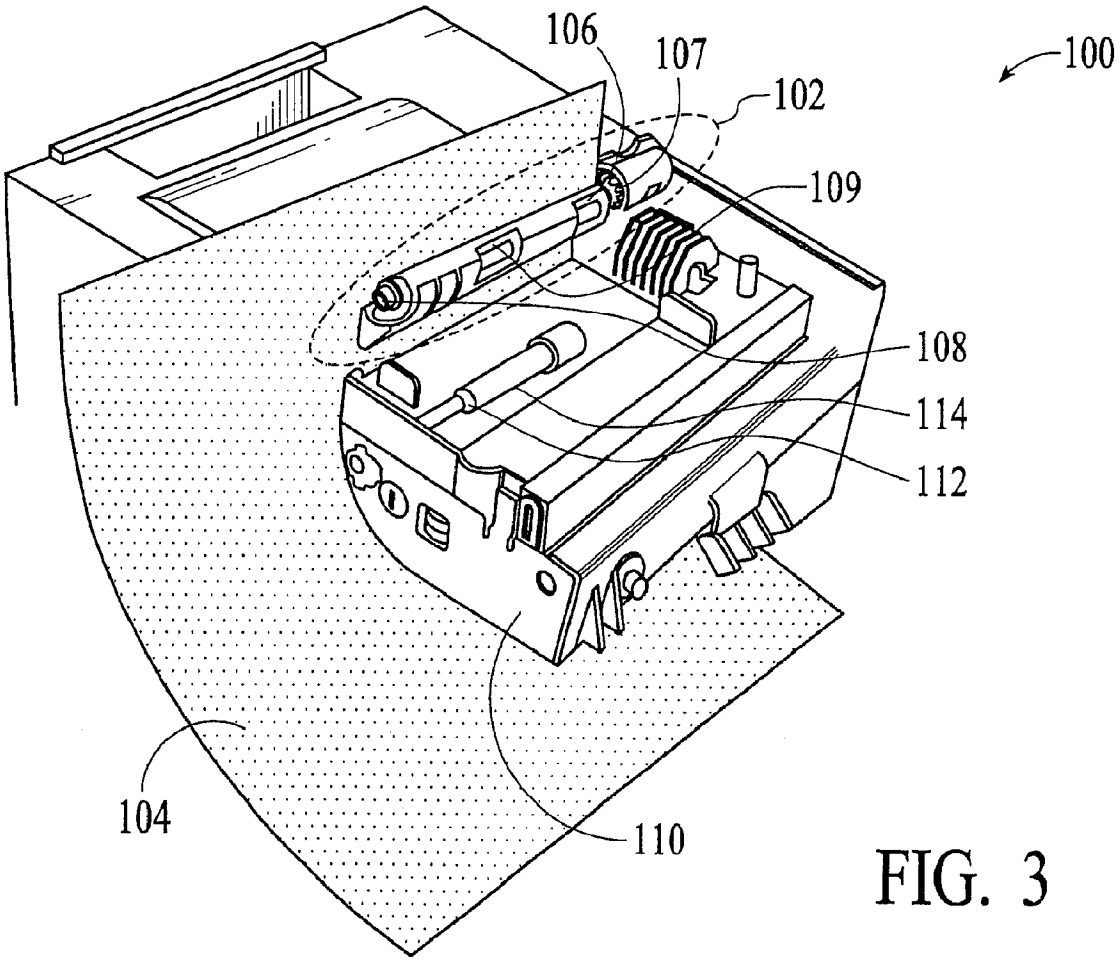
FIG. 3 a perspective-view photo of a printer with its cover opened, including a document feeder device in accordance with the present invention, and an 8.5"×11" sheet in the document feeder device.

FIG. 3 a perspective-view photo of a printer 100 with its cover opened, including a document feeder device 102 in accordance with the present invention, and an 8.5"×11" sheet 104 in the document feeder device 102. The document feeder device 102 comprises a cantilevered roller shaft 106, which is supported at its proximate end 107 (i.e., right end) (partially hidden; more clearly shown in FIG. 5) such that its distal end 108 (i.e., left end) floats. A cantilevered roller 109 is disposed around the cantilevered roller shaft 106. Alternatively there can be more than one cantilevered roller 109 disposed around the cantilevered roller shaft 106.

The advantage of the document feeder device 102 is that the distal end 108 floats thereby eliminating the need for a rigid frame that directly supports the distal end 108. This is beneficial because a front portion 110 of the printer 100 can move without disturbing the position of the cantilevered roller shaft 106 relative to the rest of the document feeder device 102. The sheet 104 is secured between the cantilevered roller 109 and a drive roller (hidden) on the other side of the sheet 104.

The printer 100 can comprise a second document feeder device, including a roller shaft 112 and a roller 114. The rest of the second document feeder device is behind the document 104 and thus hidden. The roller shaft 112 can also be cantilevered like cantilevered roller shaft 106. Alternatively, additional document feeder devices similar to the one described above can be implemented and the specific number of document feeder devices will depend on the specific application.

Figure 4:
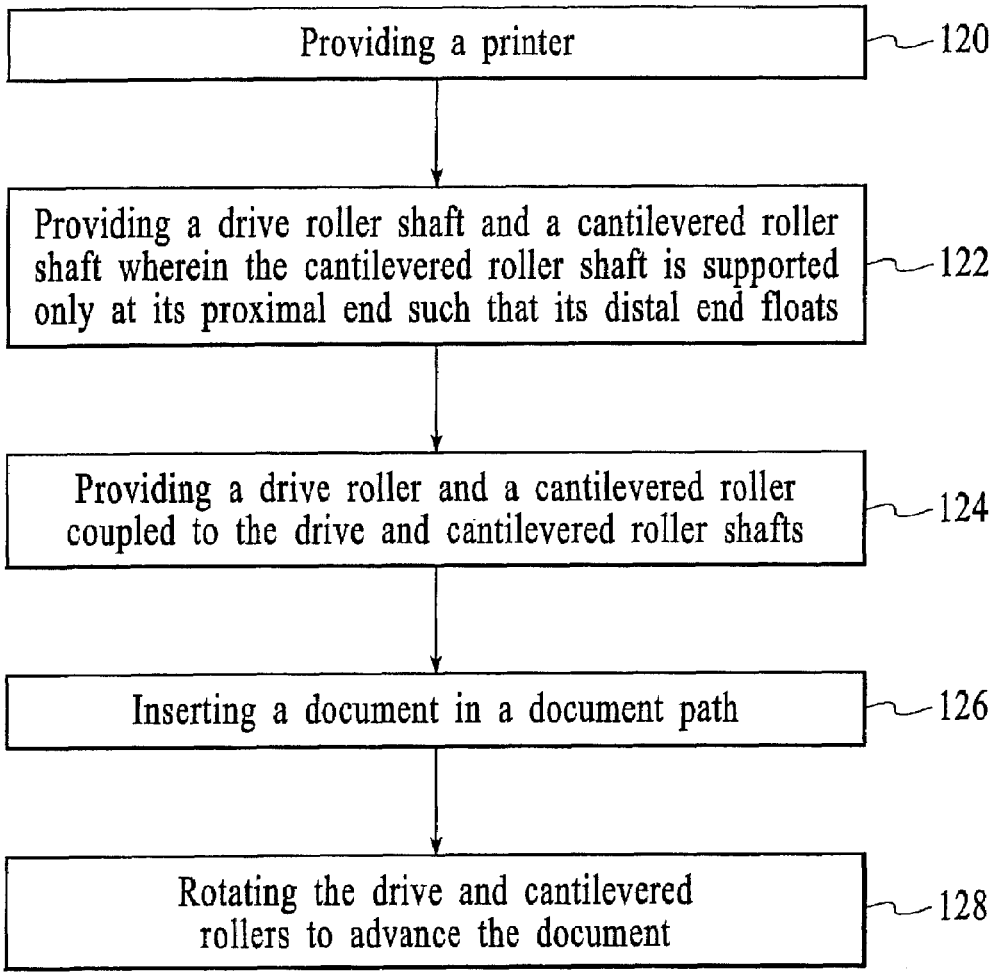
FIG. 4 is a flow chart showing a method for feeding a document through a printer in accordance with the present invention.

FIG. 4 is a flow chart showing a method for feeding a document through a printer in accordance with the present invention. Referring to FIGS. 3 and 4, in a step 120, a printer 100 is provided. In a step 122, a drive roller shaft (hidden) and a cantilevered roller shaft 106 are provided, wherein the cantilevered roller shaft 106 is supported at its proximal end such that its distal end 108 floats. In a step 124, a drive roller (hidden) and a cantilevered roller 109 coupled to the drive roller shaft (hidden) and the cantilevered roller shaft 106, respectively, are provided. In a step 126, a document 104 is inserted in a document path of the printer 100 until the document 104 reaches the drive roller and the cantilevered roller 109. In a step 128, the drive roller and the cantilevered roller 109 are rotated to advance the document 104 along the document path. When the document advances to the end of the document path, the document can then be removed from the document path.

The advantage of the document feeder device 102 is that it has at least one cantilevered roller shaft 106 that is supported at its proximal end 107. Because the distal end 108 of the cantilevered roller shaft 106 floats, the need for a rigid frame to support the distal end 108 is eliminated. The proximate end 107 has adequate support to control the position of the cantilevered roller shaft 106 relative to the rest of the document feeder device 102.

Figure 5:
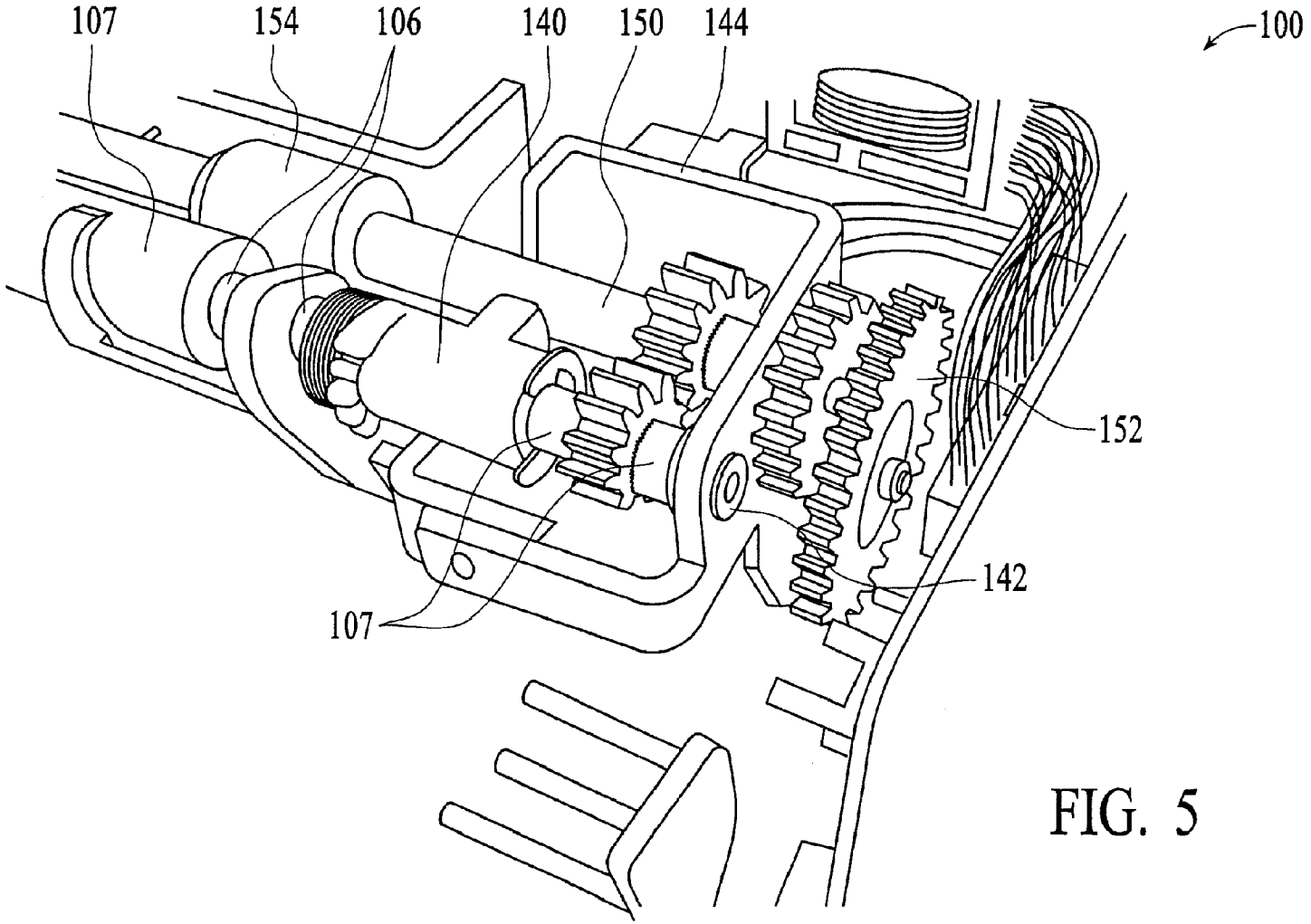
FIG. 5 is a perspective-view photo of the proximate end of the cantilevered roller shaft of FIG. 3 in accordance with the present invention.

FIG. 5 is a perspective-view photo showing in more detail how the proximal end 107 of the cantilevered roller shaft 106 of FIG. 3 is supported. The cantilevered roller shaft 106 comprises two support locations at bearings 140 and 142, which make direct contact with a frame support 144 of the printer. The frame support 144 is an integral part of the main portion of the printer frame. The front portion 110 (shown in FIG. 3) of the printer is not required to provide support for the cantilevered roller shaft 106 because the two support locations at the bearings 140 and 142 provide adequate support. The relative positions of the bearings 140 and 142 are adequately controlled, because the frame support 144 is an integral part of the printer frame and is thus stable. Accordingly, the distal end 108 of the cantilevered roller shaft 106 need not be coupled to the printer frame. The bearings 140 and 142 are relatively close together and located at the proximate end 107 of the cantilevered roller shaft 106 such that the bearings 140 and 142 are located outside the document path. Again, the cantilevered roller shaft 106 is adequately supported without the need for coupling the distal end 108 to the front portion 110 of the printer. Also, the support for the cantilevered roller shaft 106 is provided without obstructing the document path.

The printer 100 also comprises a drive roller shaft 150, which is coupled to a drive wheel 152 of a drive device (hidden) that is coupled to the frame support 144. The drive device rotates the drive roller shaft 150, which rotates the cantilevered roller shaft 106 to advance a document between the drive roller 154 and the cantilevered roller 109. This specific embodiment has two drive rollers 154. Alternatively, there can be one, or more, drive rollers depending on the specific application.

In this specific embodiment, the cantilevered roller 109 is a gimbaled roller. Gimbaled rollers are known in the art. The use of a gimbaled roller ensures balanced contact and proper alignment between itself and the drive roller. Even if the drive roller shaft 150 and cantilevered roller shaft 106 were skewed, the gimbaled roller can pivot such that the contact forces between the drive roller 154 and the cantilevered roller 109 rollers are balanced. The cantilevered roller 109 is not limited to a gimbaled roller. Alternatively, the cantilevered roller 109 can be a standard roller, such as the drive roller 154, or any other suitable device.

Figure 6:
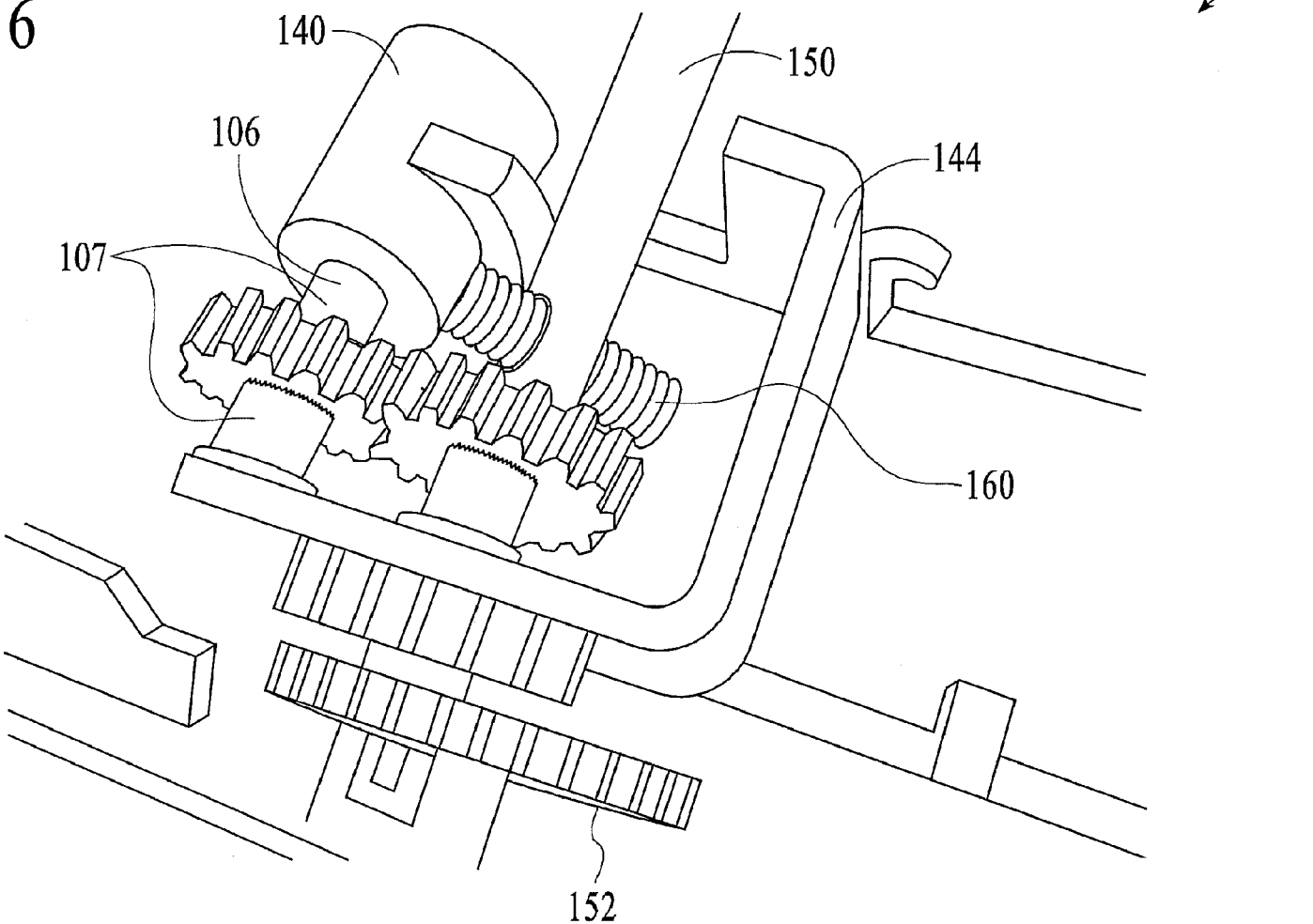
FIG. 6 is perspective-view photo of the proximate end of the cantilevered roller shaft of FIGS. 3 and 5 including a tension spring in accordance with the present invention.

In addition to providing reliable paper feeds, the cantilevered roller shaft 106 is also compliant with sheets of different thickness, because the cantilevered roller shaft 106 has freedom of movement normal to a sheet. FIG. 6 is a perspective-view photo of the proximate end 107 of the cantilevered roller shaft 106 of FIGS. 3 and 5 where a tension spring 160 is visible. The tension spring 160 connects to the bearing 140 and to the frame support 144. The cantilevered roller shaft 106 is thus spring loaded against drive roller 150. Accordingly, sheets of paper of various thicknesses can be fed through the document feeder device. In a preferred embodiment, sheets of paper up to 0.2 mm thick, or more, can be fed through the document feeder device.

Alternatively, the relative positions of the drive roller shaft 150 and the cantilevered roller shaft 106 can be switched such that the cantilevered roller shaft 106 is driven by the drive wheel 152. Thereby the cantilevered roller shaft 106 functions as a drive roller shaft, and the drive roller shaft 150 functions as a cantilevered roller shaft 106. Alternatively, both the cantilevered roller shaft 106 and the drive roller shaft 150 can be cantilevered.

Figure 7:
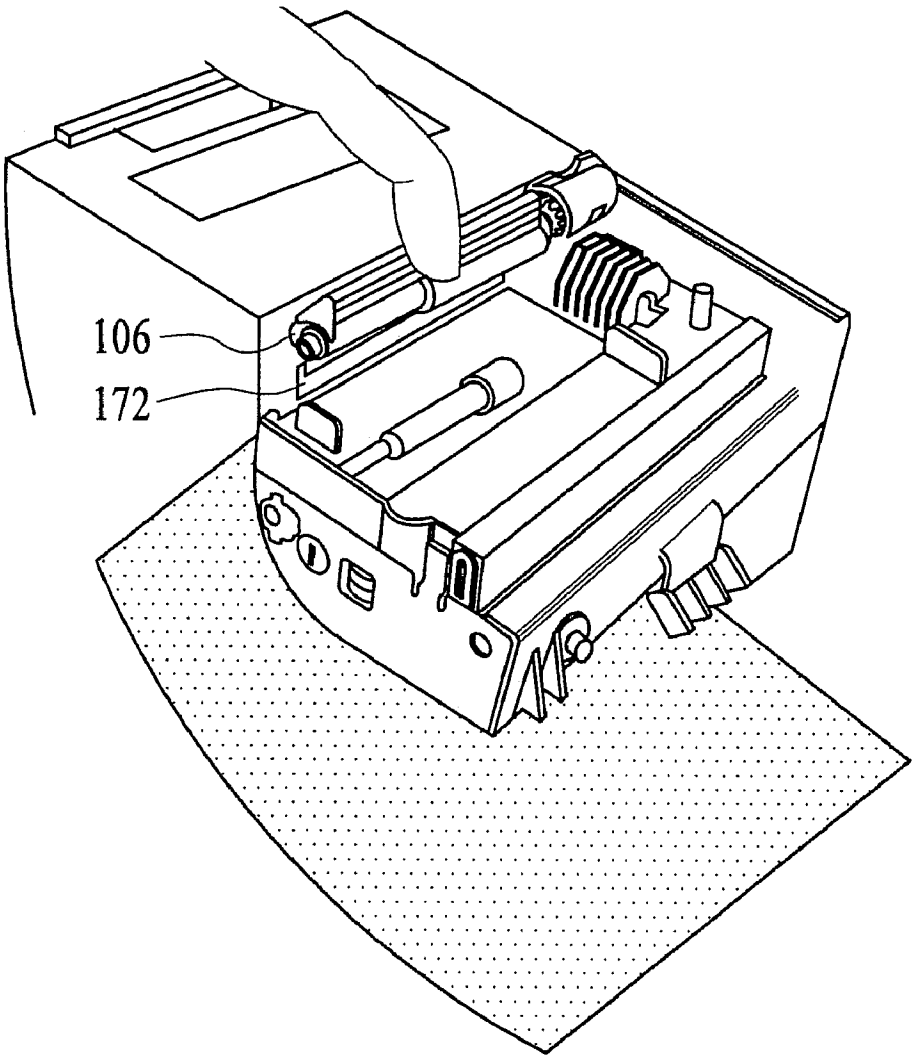
FIG. 7 is a perspective-view photo of the printer of FIGS. 3 and 5 with a scanner 172 in accordance with the present invention.

Another advantage of the document feed device in accordance with the present invention is that it can be set at different heights relative to the printer frame because of the reliable stability provided by the cantilevered roller shaft 106. This flexibility can provide additional space for additional devices, such as a scanner, to be integrated into the printer 100. FIG. 7 is a perspective-view photo of the printer 100 of FIGS. 3 and 5 with a scanner 172 in accordance with the present invention. In this specific embodiment, the scanner 172 is an optical scanner.

In accordance with the present invention, the document feeder device comprises at least one cantilevered roller shaft that is supported at one end, i.e., the proximate end. This allows the other end, i.e., the distal end, to float thereby eliminating the need for a rigid frame to support the distal end. The proximate end has adequate support to adequately control the position of the cantilevered roller shaft relative to the rest of the document feeder device. The document feeder device in accordance with the present invention eliminates the need for a rigid frame to supports the distal ends of the cantilevered roller shaft(s). This decreases the cost of production by eliminating the need for additional frame hardware or more rigid frame hardware. The document feeder device can be implemented in existing designs.

Another advantage of the document feeder device is that it allows for additional devices such as an optical scanner to be integrated with the printer without compromising the reliability of the document feeder assembly.

Note that the present invention is not limited to printers and may apply to other systems and still remain within the spirit and scope of the present invention.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A document feeder device comprising:

a frame;

at least one cantilevered roller shaft in a printer for advancing a document, wherein the at least one cantilevered roller shaft comprises a distal end and a proximal end, and wherein the proximal end is coupled to the frame such that the distal end floats;

a bearing coupled to the at least one cantilevered roller shaft, wherein the bearing includes a cylinder having a same axis as the at least one cantilevered roller shaft, wherein a portion of the cylinder is raised away from the axis, and wherein the raised portion comprises a surface that contacts a drive roller shaft; and a spring coupled to the frame and to the bearing such that the at least one cantilevered roller shaft is spring loaded against the drive roller shaft.

2. The document feeder device of claim 1 further comprising:

at least one roller coupled to the at least one cantilevered roller shaft; and at least one second roller coupled to the second roller shaft, wherein the second roller shaft comprises a second distal end and a second proximal end, wherein the second proximal end is coupled to the frame of the printer such that the second roller shaft is cantilevered and the second distal end floats, wherein the document is inserted in a document path of the printer until the document reaches the at least one roller and the at least one second roller, and wherein at least one roller and the at least one second roller is rotated to advance the document along the paper path.

3. A printer system comprising:

a frame;

at least one cantilevered roller shaft in a printer for advancing a document, wherein the at least one cantilevered roller shaft comprises a distal end and a proximal end, and wherein the proximal end is coupled to the frame such that the distal end floats;

a bearing coupled to the at least one cantilevered roller shaft, wherein the bearing is a cylinder having a same axis as the at least one cantilevered roller shaft, wherein a portion of the cylinder is raised away from the axis, and wherein the raised portion comprises a surface that contacts a drive roller shaft; and a spring coupled to the frame and to the bearing such that the at least one cantilevered roller shaft is spring loaded against the drive roller shaft.

4. The system of claim 3 further comprising:

at least one roller coupled to the at least one cantilevered roller shaft; and at least one second roller coupled to the second roller shaft, wherein the second roller shaft comprises a second distal end and a second proximal end, wherein the second proximal end is coupled to the frame of the printer such that the second roller shaft is cantilevered and the second distal end floats, wherein the document is inserted in a document path of the printer until the document reaches the at least one roller and the at least one second roller, and wherein at least one roller and the at least one second roller is rotated to advance the document along the paper path.

* * * * *